United States Patent [19]

Langson

[11] Patent Number: 4,668,451

[45] Date of Patent: May 26, 1987

[54] PROCESS OF MAKING A FULL LIFE SIZE ARTIFICIAL ROCK FORMATION FROM A NATURAL ROCK FORMATION SURFACE

[76] Inventor: Bruce K. Langson, The Gunite Co., 11320 F.M. 529, Bldg. 1, Houston, Tex. 77041

[21] Appl. No.: 732,181

[22] Filed: May 9, 1985

[51] Int. Cl.[4] ..... B28B 7/04

[52] U.S. Cl. ..... 264/39; 264/220; 264/225; 264/245; 264/256; 264/308; 264/309; 264/313; 264/510; 264/571; 264/DIG. 78; 428/15

[58] Field of Search ..... 264/220, 225, 226, 227, 264/245, 256, 39, 309, 308, 313, 73, 510, 571, DIG. 78; 428/15

[56] References Cited

U.S. PATENT DOCUMENTS 4,043,826 8/1977 Hum ..... 264/133 X 4,496,511 1/1985 Virgili ..... 264/225

*Primary Examiner*—Jan Silbaugh
*Assistant Examiner*—Harold Y. Pyon
*Attorney, Agent, or Firm*—Robert J. Marett

[57] ABSTRACT

A process of making a full life size artificial rock formation of photocopy exactness from a natural rock formation surface is disclosed herein. A plurality of coats of latex is applied over the natural rock surface and allowed to dry thus forming a mask having all the natural cracks and crevices of the natural rock surface. This mask or liner is held in a fiberglass mold and a vacuum is applied to the inner surface of said liner causing all the cracks and crevices to open up. Cement is applied to the outer surface of the liner filling all the cracks and crevices. When the liner is removed the artificial surface resembles the natural rock surface in photocopy exactness.

19 Claims, 20 Drawing Figures

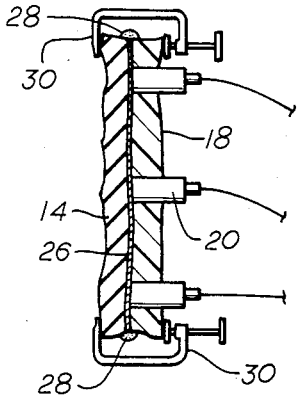
FIG. 11
START VACUUM PUMP
FIG. 12
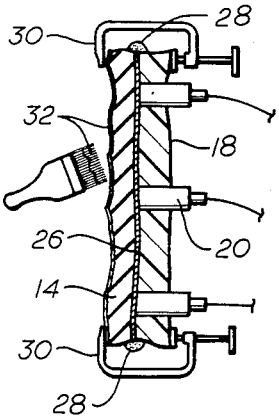
FIG. 13
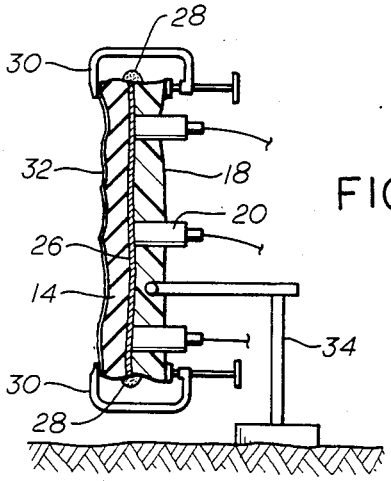
FIG. 14
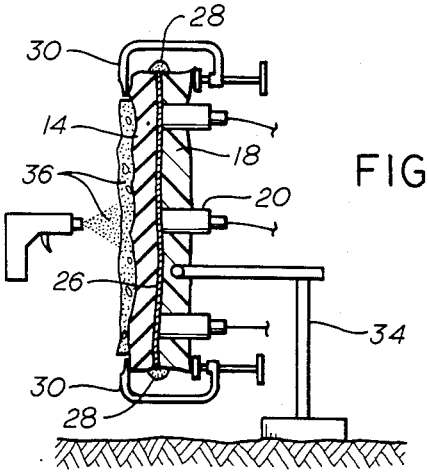
FIG. 15
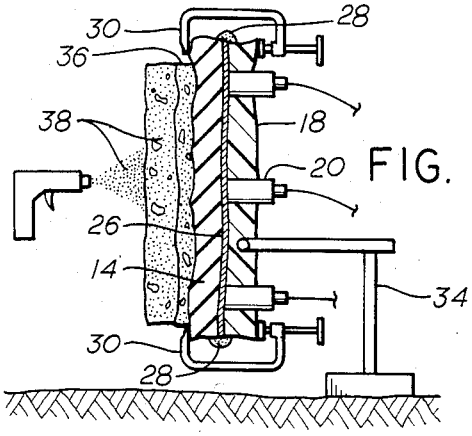
FIG. 16
LET MOLD CURE
FIG. 17
RELEASE VACUUM LINES
FIG. 18
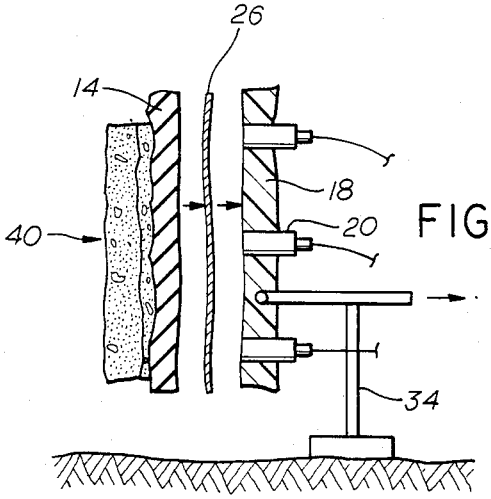
FIG. 19
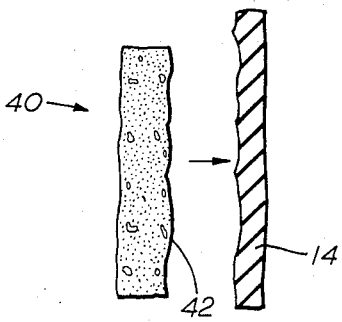
FIG. 20

PROCESS OF MAKING A FULL LIFE SIZE ARTIFICIAL ROCK FORMATION FROM A NATURAL ROCK FORMATION SURFACE

BACKGROUND OF THE INVENTION

1. Field of the Invention

This invention relates to a method of making artificial rocks and rock formations and more particular to a new, novel and unobvious method of making a full life size artificial rock formation from natural rocks and natural rock formations.

2. Description of the Prior Art

Large rocks, boulders and combinations of rocks and boulders forming cliffs have been used for decorative or simulative purposes in landscape gardening, museum dioramas, waterfalls, rock gardens, habitats for animals in zoos, and marine seascapes. Natural rocks are obviously very heavy to handle and transport and often too heavy to be supported on conventional floors. The advent over the years of new materials for producing artificial rock formations have made these rockscapes very appealing to people or companies desiring same. However, the materials and methods currently used to make artificial rock formations all lack a certain degree of authenticity when used as substitutes for the rockscape found in nature.

Consequently, a need exists for improvements in techniques for making artificial rock formations which will result in the artificial rock formations more closely resembling the natural rocks found in nature.

Methods of making artificial rock formations are in the prior art. Representative patents in the general area of making artificial rock formations are U.S. Pat. Nos. 4,082,871 (method for forming a decorative novelty device); 4,244,993 (method for making simulated marble and product of the method); 4,385,088 (decorative artificial rock like article); 3,836,619 (method of forming artificial stone); 4,043,826 (process for making artificial rocks); 3,924,037 (method for making artificial stone); 3,546,052 (artificial rocks having shells filled with fluent material).

Although the above referenced patents represent various variations of making artificial rock formations, there are basically two methods of making or producing large rock formations, known in the industry as rockscapes.

The first method is the casting method. This involves casting small "turtle shell" rocks, stacking and joining them together structurally, and hand tooling all the joint areas to make one large rockscape. This method has several drawbacks in that it is slow, costly and requires many skilled hand tooling artists. The casting method cannot reproduce an exact reproduction of a natural rock wall formation and all its features due to the size limitations of the casted rocks and the inability to produce overhangs and out croppings without a large amount of time and expense. Further, a rockscape made by the casting method has the appearance of being made from many small rocks and thus looses its natural look.

The second method of making large rockscapes is known as the direct method. The direct method involves the use of reinforcing steel bars bent and tied together in such a way so as to try to attempt to resemble a rock formation shape. Expanded metal is layed over the reinforcing rods and covered with mortar. While the motar is still wet, artists attempt to carve and work the mortar to make it look like a real rock surface. The drawback of the direct method is that it requires a number of skilled artists to carve the mortar and still the finished product does not resemble a natural rock surface with all the little cracks, crevices and pores a natural rock surface has. To employ a crew of artists to create in exact detail the rock surface would be cost prohibitive for any job.

Thus, none of the prior art approaches disclose the method of the present invention wherein a full life size rockscape is made with photocopy exactness from a natural rock formation.

SUMMARY OF THE INVENTION

It is therefore, among one of the principal objectives of this invention to provide a method of making full life size artificial rock formations from natural rock formations not heretofore produced by the prior art.

In accordance with the invention, one locates the natural rock formation in nature. This may be a large rock or an entire cliff or rock wall. There is no limit to the size of the formation one wishes to duplicate. After the natural rock formation is found, it is cleaned of any dirt, weeds or foreign matter by washing it with a wash medium and then allowing the surface to dry. The method then continues with applying a plurality of coats of latex to the rock surface to form a latex liner; applying a bond breaker over the surface of the latex liner; applying fiberglass over the bond breaker to form a cradle; removing the cradle from the latex liner; removing the latex liner from the rock surface; cleaning the latex liner and cradle; installing vacuum lines to the cradle; applying a filter cloth inside the cradle to evenly distribute the vacuum; placing the latex liner on top of the filter cloth; sealing around the periphery of the latex liner with caulk; applying clamps around the periphery of the liner; applying a vacuum to the liner through the vacuum lines; applying highlight color to the latex liner; bracing the cradle in the desired position; applying color cement onto the latex liner; applying regular cement over the color cement; allowing the cement to cure; releasing the vacuum; removing the cradle; and finally removing the latex liner from the cement. The bond breaker can be any substance which will separate the bond between two materials which will prevent the two materials from sticking together,

BRIEF DESCRIPTION OF THE DRAWINGS

FIG. 11 illustrates the step of applying clamps around the periphery of the liner;

FIG. 12 illustrates the step of applying a vacuum by starting the vacuum pump;

FIG. 13 illustrates the step of applying highlight color to the outer surface of the latex liner;

FIG. 14 illustrates the step of bracing the cradle in position;

FIG. 15 illustrates the step of applying color cement over the highlight color;

FIG. 16 illustrates the step of applying structural cement over the color cement;

FIG. 17 illustrates the step of allowing the mold to cure;

FIG. 18 illustrates the steps of releasing the vacuum from the mold structure;

FIG. 19 illustrates the steps of removing the cradle and filter cloth from the latex liner;

FIG. 20 illustrates the step of removing the latex liner from the artificial rock surface made.

DESCRIPTION OF THE PREFERRED EMBODIMENT

Figure 1:
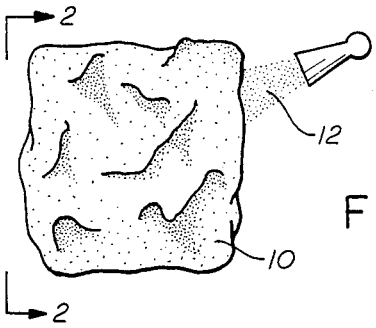
FIG. 1 is a perspective view of the surface of a large natural rock formation being cleaned.

The method of making a full life size artificial rock formation according to the present invention begins with locating the rock formation in nature one wants to duplicate. This could be any rock wall, large boulder or entire cliff. Then the method, corresponding to each figure number, comprises the steps of:

1. Referring to FIG. 1, the surface 10 of a rock formation is thoroughly cleaned by: washing it with an aqueous wash medium; removing any dirt; removing any weeds; and blowing any debris out of all the cracks and crevices.

Figure 2:
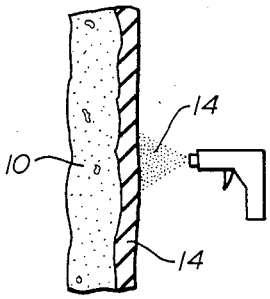
FIG. 2 is a cross sectional detail of the rock surface taken along lines 2—2 of FIG. 1 and illustrating the step of applying latex to the rock surface.

2. Referring to FIG. 2, after the surface 10 of the rock formation has dried, a plurality of coats of latex 14 is applied over the surface 10 of the rock formation. This is accomplished by first applying several coats of pure latex over the surface of the rock formation. Then chopped fiberglass strands for strength are added to the latex being applied. Finally, several coats of pure latex are applied. When this mixture dries, a solid latex liner 14 is made which covers the entire surface of the rock formation. When the latex liner is removed from the rock formation, in a later step, the inner surface of the liner will have all the cracks and crevices in photocopy exactness of the natural rock surface.

Figure 3:
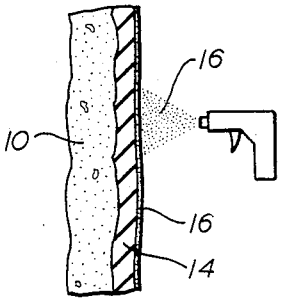
FIG. 3 illustrates the step of applying a bond breaker on the surface of the latex.

3. Referring to FIG. 3, a bond breaker material 16 is applied on top of the latex liner to prevent the latex from sticking to the fiberglass which is applied in the next step.

Figure 4:
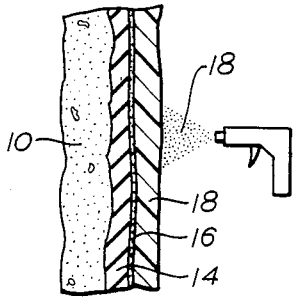
FIG. 4 illustrates the step of applying fiberglass over the bond breaker to form a cradle.

4. Referring to FIG. 4, fiberglass 18 is applied on top of the bond breaker 16 and allowed to dry.

Figure 5:
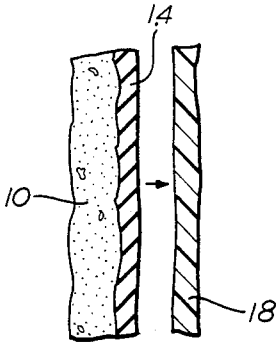
FIG. 5 illustrates the step of removing the cradle from the latex liner.

5. Referring to FIG. 5, after the fiberglass 18 has set up, it is separated from the latex liner 14.

Figure 6:
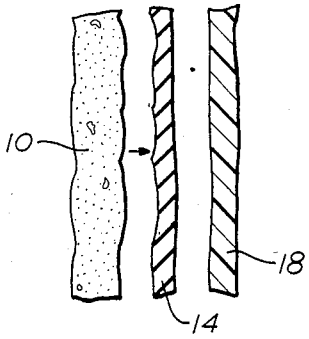
FIG. 6 illustrates the step of removing the latex liner from the rock surface.

6. Referring to FIG. 6, the latex liner 14 is removed from the rock surface 10.

Figure 7:
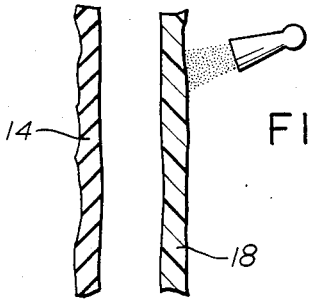
FIG. 7 illustrates the step of cleaning the latex liner and cradle.

7. Referring to FIG. 7, both the latex liner 14 and the fiberglass cradle 18 are cleaned with an aqueous wash medium.

Figure 8:
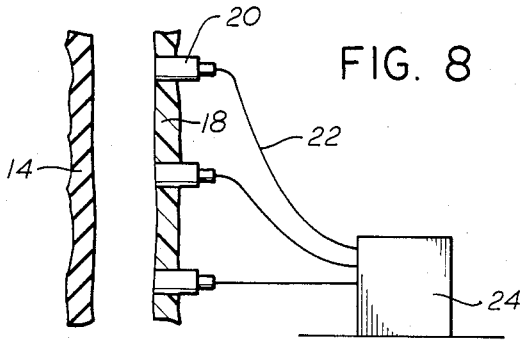
FIG. 8 illustrates the step of installing vacuum lines and ports to the cradle.

8. Referring to FIG. 8, holes are drilled in the fiberglass craddle 18 and vacuum ports 20 are installed therein to receive vacuum lines 22 from a vacuum pump 24.

Figure 9:
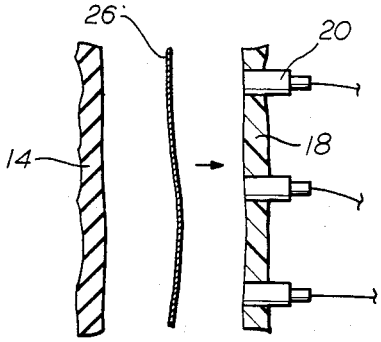
FIG. 9 illustrates the step of applying a filter cloth in the cradle.

9. Referring to FIG. 9, a filter cloth 26 is placed inside the fiberglass cradle 18 to evenly distribute the vacuum pressure across the face of the latex liner 14 when the vacuum is applied.

Figure 10:
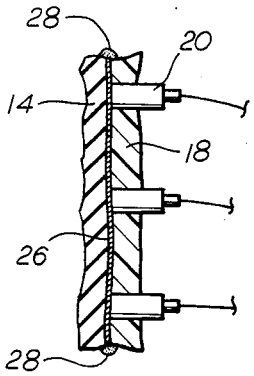
FIG. 10 illustrates the step of sealing the latex liner to the cradle with caulk.

10. Referring to FIG. 10, the latex liner 14 is placed on top of the filter cloth 26 and the liner 14 is sealed to the fiberglass cradle 18 around the periphery of the filter cloth with caulk 28.

11. Referring to FIG. 11, clamps 30 are applied around the periphery of the mold structure to prevent the edges of the latex liner 14 from curling up.

12. Referring to FIG. 12, along with FIG. 11, the vacuum pump is now started which supplies a vacuum into the mold structure through the vacuum lines biasing the latex liner 14 against the fiberglass cradle 18 and holding it in place. The filter cloth 26 allows for an even distribution of the vacuum across the surface of the latex liner and allows the outer surface of the latex liner to open up all its cracks and crevices which are the mirror image of the cracks and crevices of the surface of the natural rock formation.

13. Referring to FIG. 13, highlight color paint 32 is applied to the outer surface of the latex liner 14 to produce rock highlights and shading.

14. Referring to FIG. 14, the mold structure is placed in the desired position and supported and held in place by a frame 34.

15. Referring to FIG. 15, colored cement 36 is applied over the highlight color 32 and the latex liner 14 producing the rock color of the formation duplicating the surface of the natural rock formation.

16. Referring to FIG. 16, structural cement 38 is applied over the colored cement 36 to add strength to the structure. Reinforcing support can also added to the concrete such as rebar in the conventional manner to add further support.

17. Referring to FIG. 17, the mold structure is allowed to cure.

18. Referring to FIG. 18, the vacuum lines are released from the mold structure.

19. Referring to FIG. 19, the fiberglass cradle 18 and filter cloth 26 are removed from the latex liner 14.

20. Referring to FIG. 20, the latex liner 14 is pealed off the surface of the artificial rock formation 40, formed by the concrete 36 and 38, leaving its surface 42 an exact duplicate of the surface 10 of the natural rock formation.

While the invention has been described with reference to a preferred embodiment, it will be obvious to one skilled in the art that modifications and variations of the invention may be constructed and employed without departing from the scope of the invention. The scope of the invention is defined in the following claims.

I claim

1. A process of making a full life-size artificial rock formation from a natural rock formation surface comprising the steps of:

(a) applying latex over the rock surface to form a latex liner;

(b) applying a bond breaker over the latex liner;

(c) applying fiberglass over the bond breaker to form a cradle;

(d) removing the latex liner and the cradle from the rock surface;

(e) installing a filter cloth between said latex liner and said cradle;

(f) sealing around the periphery of the latex liner and cradle to seal the area between cradle latex liner;

(g) applying a vacuum within said cradle between the cradle and the filter cloth to hold the latex liner in place against the filter cloth and cradle;
(h) applying structural cement over the outer surface of the latex liner;
(i) removing the cradle, filter cloth and latex liner from the surface of the formed structure cement.

2. A process according to claim 1 wherein step (a) includes applying a plurality of coats of latex having chopped fiberglass mixed with latex for strength.

3. A process according to claim 2 wherein step (a) includes allowing the plurality of coats of latex to cure.

4. A process according to claim 3 wherein step (b) includes a step of allowing the fiberglass to cure.

5. A process according to claim 4 wherein step (d) includes a step of separating the latex liner from the cradle prior to installing the filter cloth.

6. A process according to claim 5 wherein step (d) further includes washing the latex liner and cradle with an aqueous wash medium and allowing both to dry prior to installing the filter cloth.

7. A process according to claim 6 wherein step (e) includes sealing the periphery of the latex liner to the cradle with caulk.

8. A process according to claim 7 wherein step (e) further includes applying clamps around the periphery of the liner and cradle.

9. A process according to claim 8 wherein step (f) includes a step of installing vacuum ports to the cradle and lines to said ports running to a vacuum pump prior to applying the vacuum.

10. A process according to claim 9 wherein step (f) includes applying highlight color to the outer surface latex liner.

11. A process according to claim 10 wherein step (f) further includes positioning the cradle in position and bracing it.

12. A process according to claim 11 wherein step (f) further includes applying color cement to the outer surface of the latex liner over the highlight color after the cradle is positioned and allowing said color cement to cure.

13. A process according to claim 12 wherein said structural cement applied to step (g) comprises materials selected from the group of regular cement, steel supports, chopped steel fibers and mixtures thereof and allowing the mixture to cure.

14. A process according to claim 13 wherein step (a) includes cleaning the surface of the rock formation prior to applying latex over its surface.

15. A process of making a full life size artificial rock formation from a natural rock formation surface comprising the steps of :

(a) cleaning the surface of the natural rock formation;
(b) applying a latex to the surface of the natural rock formation forming a latex liner;
(c) applying a bond breaker coating over the latex liner;
(d) applying fiberglass over the bond breaker to form a cradle;
(e) removing the cradle;
(f) removing the latex liner from the surface of the natural rock formation;
(g) cleaning the latex liner and cradle;
(h) installing vacuum ports and lines to the cradle and connecting a vacuum pump to said lines;
(i) applying a filter cloth inside the cradle;
(j) sealing the latex liner to the cradle;
(k) applying clamps around the periphery of the liner;
(l) applying a vacuum to the line through vacumm lines to hold the latex liner in place against the filter cloth and cradle;
(m) applying highlight color to the outer surface of the latex liner;
(n) bracing the cradle in position;
(o) applying color cement onto the outer surface latex liner;
(p) applying structural cement over the color cement;
(q) allowing the cement to cure to form the full life-size artificial rock formation;
(r) releasing the vacuum;
(s) removing the cradle and filter cloth from the latex liner;
(t) removing the latex liner from the formed product.

16. A process according to claim 15 wherein applying the latex in step (b) includes applying a plurality of coats of latex including chopped fiberglass mixed with the latex for strength.

17. A process according to claim 16 wherein said structural cement applied in step (p) comprises materials selected from the group of regular cement, steel supports, chopped steel fibers and mixtures thereof.

18. A process according to claim 17 wherein after steps (a), (b), (c), (d), (g), (m), (o), and (p), the process is allowed to dry or cure prior to the application of the next step.

19. A process of making a full life size artificial rock formation from a natural rock formation surface comprising the steps of:

(a) cleaning the surface of a natural rock formation;
(b) allowing the rock surface to dry;
(c) applying a plurality of coats of latex to the surface of the natural rock formation;
(d) applying a second plurality of coats of latex mixed with chopped fiberglass straws over the first plurality of coats of latex;
(e) applying a third plurality of coats of pure latex over the second plurality of coats of latex forming a latex liner;
(f) applying a bond breaker coating over the latex liner;
(g) applying fiberglass over the bond breaker;
(h) allowing the fiberglass to cure thus forming a cradle;
(i) removing the cradle and latex liner from the surface of the natural rock formation;
(j) removing the cradle from the latex liner;
(k) cleaning the latex liner and the cradle;
(l) installing vacuum ports and lines to the cradle and connecting a compressor to said lines;
(m) applying a filter cloth inside the cradle;
(n) placing the latex liner on top of the filter cloth;
(o) sealing the latex liner to the cradle around their common periphery with caulk;
(p) applying clamps around the periphery of the liner and cradle;
(q) applying a vacuum to the liner through the vacuum lines to hold the latex liner in place against the filter cloth and cradle;
(r) applying highlight color to the outer surface of the latex liner;
(s) positioning the cradle and bracing it;
(t) applying color cement onto the outer surface of the latex liner over the highlight color;
(u) allowing the color cement to cure;

(v) applying structural cement over the color cement wherein said structural cement comprises materials selected from the group of regular cement, steel supports, chopped steel fibers and mixtures thereof;

(w) allowing the structural cement to cure to form the full life-size artificial rock formation;

(x) releasing the vacuum;

(y) removing the cradle and filter cloth;

(z) removing the latex liner from the color cement and formed product.

* * * * *